US005609101A

United States Patent [19]

Oyama et al.

[11] Patent Number: 5,609,101

[45] Date of Patent: Mar. 11, 1997

[54] INK CONTAINER HOLDING DEVICE IN ROTARY PRINTING MACHINE

[75] Inventors: Koichi Oyama; Kuninori Sasaki, both of Tokyo, Japan

[73] Assignee: Riso Kagaku Corporation, Tokyo, Japan

[21] Appl. No.: 559,484

[22] Filed: Nov. 15, 1995

[30] Foreign Application Priority Data

Nov. 16, 1994 [JP] Japan ..... 6-282211

[51] Int. Cl.[6] ..... B41F 15/40; B41L 13/00

[52] U.S. Cl. ..... 101/116; 101/366

[58] Field of Search ..... 101/115, 116, 101/119, 120, 366, 335, 364

[56] References Cited

FOREIGN PATENT DOCUMENTS

| | | |
|---|---|---|
| 523635 | 1/1993 | European Pat. Off. . |
| 640492 | 3/1995 | European Pat. Off. . |
| 63-265679 | 2/1988 | Japan . |
| 227804 | 6/1991 | Japan . |
| 726133 | 6/1995 | Japan . |

OTHER PUBLICATIONS

Patent Abstracts of Japan, vol. 015, No. 441 (M–1177), Nov. 11, 1991, JP–A–03 184889 (Ricoh Co Ltd), Aug. 12, 1991.

Patent Abstracts of Japan, vol. 014, No. 420 (M–1023), Sep. 11, 1990, JP–A–02 164576 (Seiki Ind. Co., Ltd), Jun. 25, 1990.

Patent Abstracts of Japan, vol. 95, No. 008, JP–A–07 227957 (Riso Kagaku Corp), 29 Aug. 1995.

*Primary Examiner*—J. Reed Fisher

*Attorney, Agent, or Firm*—Sughrue, Mion, Zinn, Macpeak & Seas

[57] ABSTRACT

An ink container holding device for a rotary printing machine includes: a pack holder detachably receiving an ink container; a support table on which the pack holder is slidably mounted, wherein the pack holder is slidable between a connecting position where an ink discharge port of the ink container is connected to an ink suction port of an ink supplying pump and a disconnecting position where the ink discharge portion is disconnected from the ink suction port; a supporting member on which the support table is secured, the supporting member being movable between a first position inside the printing machine body and a second position outside the printing machine body; a holder set board secured to the printing machine body; and a hook lever connecting to the pack holder, wherein the hook lever moves the pack holder to the connecting position by engaging the hook lever with the holder set board in accordance with the supporting member moving to the first position.

12 Claims, 9 Drawing Sheets

INK CONTAINER HOLDING DEVICE IN ROTARY PRINTING MACHINE

BACKGROUND OF THE INVENTION

This invention relates to an ink container holding device in a rotary printing machine.

In some of the rotary printing machines, in order to supply printing ink into the printing drum an ink pump is operated to suck printing ink out of a small ink container which is detachably set at a predetermined position.

In a rotary printing machine disclosed, for instance, by Japanese Utility Patent Application Laid-open No. Sho. 62-102666, an ink container accommodating device is provided in the printing machine body, and an ink container is set on a supporting stand of the ink container accommodating device. The ink discharge port of the ink container thus set is connected to or disconnected from the ink suction port of an ink pump built in the printing machine body by operating a cover which is provided for the printing machine body. More specifically, the ink discharge port is connected to the ink suction port by closing the cover, and the former is disconnected from the latter by opening the cover.

In the above-described conventional rotary printing machine, the ink container accommodating device is provided inside the printing machine body. Hence, even if the cover is opened wide, the operator cannot see the supporting stand, on which the ink container is set, without lowering his head. Therefore, when it is required to set or remove the ink container, he must take an uncomfortable posture bending himself to look in the ink container accommodating device, and therefore it is rather difficult for him to achieve the ink container setting or removing operation with high work efficiency. This difficulty is significant especially with a recent printing machine in which the operating panel is made large in size because the printing machine has multiple functions, and extends forwardly from the printing machine body.

Furthermore, in the above-described conventional rotary printing machine, it is impossible to detect the state of the ink container after the closure of the cover provided for the printing machine body. Therefore, the printing operation may be started although the ink container is not correctly set. If the printing operation is started in this way, then the supplying of the printing ink may be stopped, or the printing ink may leak out through the junction of the ink discharge port of the ink container and the ink suction port of the ink pump.

SUMMARY OF THE INVENTION

An object of the invention is to eliminate the above-described difficulties accompanying a conventional rotary printing machine. More specifically, an object of the invention is to provide an ink container holding device for a rotary printing machine which is so designed that the operator can quickly and readily replace the ink container in a comfortable posture, and a printing operation is started only when the ink container is set correctly, and the difficulties are eliminated that, during printing, the supplying of the printing ink is stopped or the printing ink leaks out through the junction of the ink discharge port of the ink container and the ink suction port of the ink pump.

To achieve the objects, according to a first aspect of the invention, there is provided an ink container holding device for a rotary printing machine in which an ink container is detachably provided in a printing machine body and in which an ink is supplied from an ink discharge port of the ink container to an ink suction port of an ink supply pump, the ink container holding device comprising: a supporting member which is movable between a first position inside the printing machine body and a second position outside the printing machine body; ink container holding means provided on the supporting member, for holding the ink container, wherein the ink container holding means is movable between a connecting position where the ink discharge port of the ink container is connected to the ink suction port of the ink supplying pump and a disconnecting position where the ink discharge port is disconnected from the ink suction port; and operating means for moving the ink container holding means to the connecting position in association with the movement of the supporting member to the first position inside the printing machine body.

According to a second aspect, there is provided the ink container holding device of the first aspect, further comprising: detecting means for detecting when the ink container is set in the ink container holding means.

According to a third aspect, there is provided the ink container holding device of the first aspect, further comprising: detecting means for detecting when the ink container is set in the ink container holding means, to output a detection signal; and control means for controlling the printing machine such that the printing machine is allowed to perform a printing operation when, with the supporting member set-at the first position inside the printing machine body, the detecting means outputs the detection signal, and the printing machine is not allowed to perform the printing operation when, with the supporting member set at the first position, the detecting means outputs no detection signal.

According to a fourth aspect, there is provided the ink container holding device of the first aspect, further comprising: locking means for locking the ink container holding means at the connecting position upon movement of the ink container holding means to the connecting position where the ink discharge port of the ink container is connected to the ink suction port.

According to a fifth aspect, there is provided the ink container holding device of the fourth aspect, wherein the ink container holding device further comprises urging means for urging the ink container holding means from the connecting position towards the disconnecting position, the locking means is so designed as to eliminate the locking of the ink container holding means when the supporting member is at the second position outside the printing machine body, and, when the locking of the ink container holding means is eliminated by the locking means, the ink container holding means is moved to the disconnecting position by the energizing force of the urging means.

According to a sixth aspect, there is provided the ink container holding device of the first aspect, wherein the rotary printing machine has a printing drum which is turned with an original form on the outer cylindrical surface thereof, and the supporting member rotatably supports the printing drum.

The printing drum is rotated inside the printing machine body to perform a printing operation. In order to replace a color printing drum for a multi-color printing operation, or to remove jammed sheets, or to replace a printing ink, the printing drum is moved out of the printing machine body with the aid of a guide mechanism.

The ink container is set in the ink container holding means from above. Thereafter, the printing drum is moved to the printing position. In response to this movement, the operating means moves the ink container holding means.

As a result, the ink discharge port of the ink container is connected to the ink suction port provided for an ink pump, so that the printing ink is supplied.

Whether or not the ink container is set in the ink container holding means is detected by the detector when the printing drum is set inside the printing machine body, whereby the connection of the ink discharge port of the ink container to the ink suction port provided for the ink pump is electrically detected, which contributes to stabilization of the printing operation.

DETAILED DESCRIPTION OF THE PREFERRED EMBODIMENTS

The invention will be described with reference to its preferred embodiment shown in the accompanying drawings.

Figure 1:
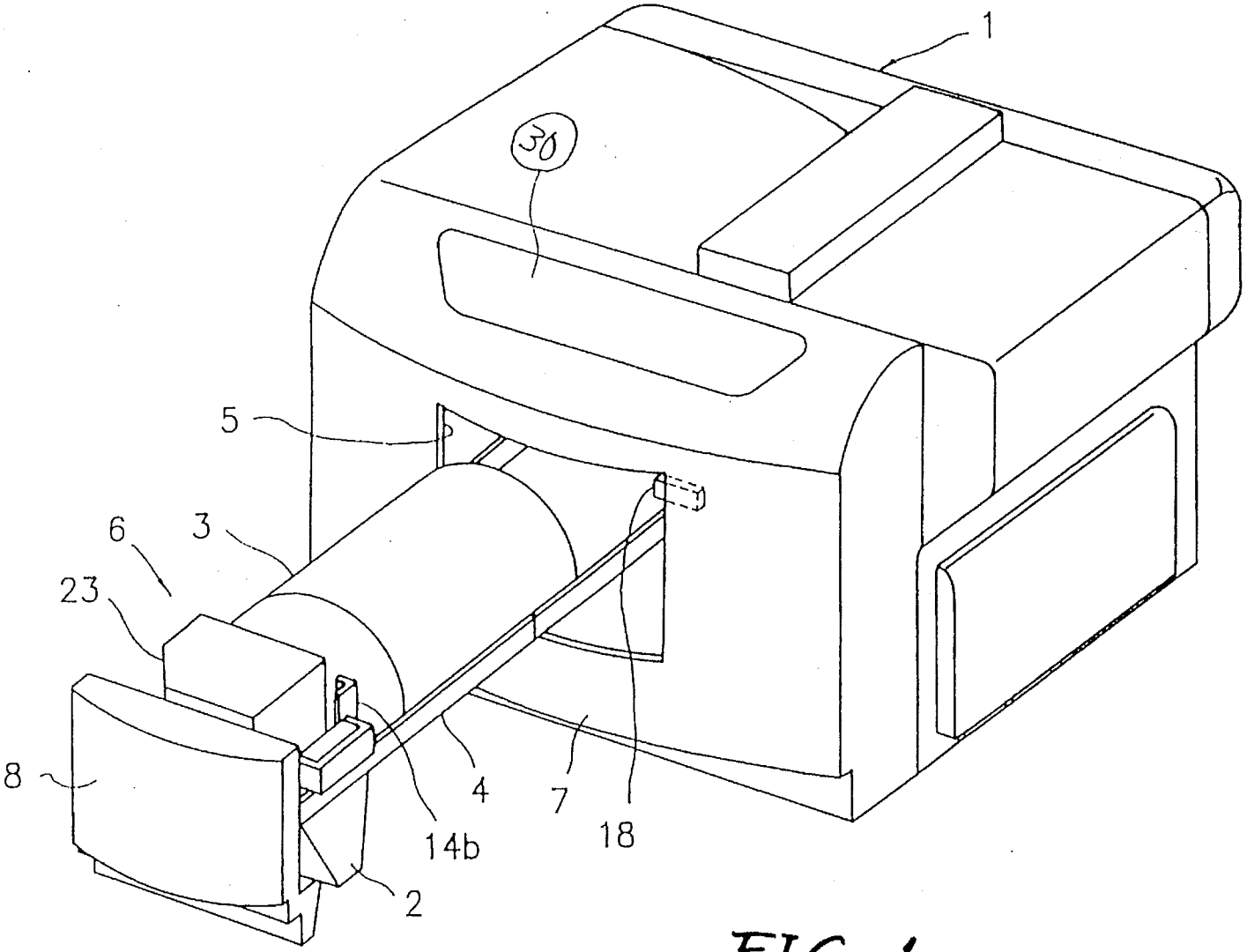
FIG. 1 is a perspective view showing an external appearance of a rotary printing machine to which an ink container holding device according to the invention is applied.

FIG. 1 is a perspective view showing an external appearance of a rotary printing machine to which an ink container holding device according to the invention is applied.

In FIG. 1, reference numeral 1 designates a printing machine which is a rotary printing machine. The printing machine 1 has a printing drum 3 which is rotatably supported by a supporting member 2.

A rail-like guide mechanism 4 is provided between the supporting member 2 and the frame of a printing machine body (hereinafter referred to as "a machine frame", when applicable) which is made up of a plurality of rails laid on both sides of the supporting member 2. By contracting those rails, the supporting-member 2 and the printing drum 3 are moved to a printing position inside the machine frame; and by stretching the rails, the supporting member 2 and the printing drum 3 are moved to a non-printing position outside the machine frame through an opening 5 formed therein.

At the non-printing position, the printing drum 3 can be mounted on the supporting member 2 or detached from the supporting member 2 (cf. Japanese Patent Application Laid-open No. Sho. 63-265679 in detail).

An operating panel 30 is provided on the upper portion of the front of the printing machine body, to control the printing operation. More specifically, the operating panel 30 is located right above the opening 5 of the printing machine body. When the printing drum 3 is set inside the printing machine body, an ink container 23 is located right below the operating panel 30. When the printing drum 3 is pulled out of the machine frame as shown in FIG. 1, the ink container 23 is located at its outermost position as viewed in the direction in which the printing drum 3 is pulled out, so that replacement of the ink container 23 can be achieved at the position which is away from the operating panel 30.

An ink container holding device 6 is provided on the supporting member 2; more specifically, it is located in front of the printing-drum 3 on the supporting member 2. A cover 8 is mounted on the front end of the supporting member 2.

The cover 8 is designed as follows: When the printing drum 3 is at the printing position inside the printing machine body, the cover 8 is fitted in the opening 5 of the printing machine body as if it were integral with the front wall 7 of the printing machine body, and the surface of the cover 8 is flush with that of the front wall 7; more specifically, as shown in FIG. 1, the surface of the cover 8 and the surface of the front wall 7 are curved with one and the same curvature.

The color of the cover 8 may be made equal to the color of ink to be used. This may eliminate the difficulty that, in a color printing operation, the printing drum is replaced with a different one, and may improve the design of the cover 8.

Figure 2:
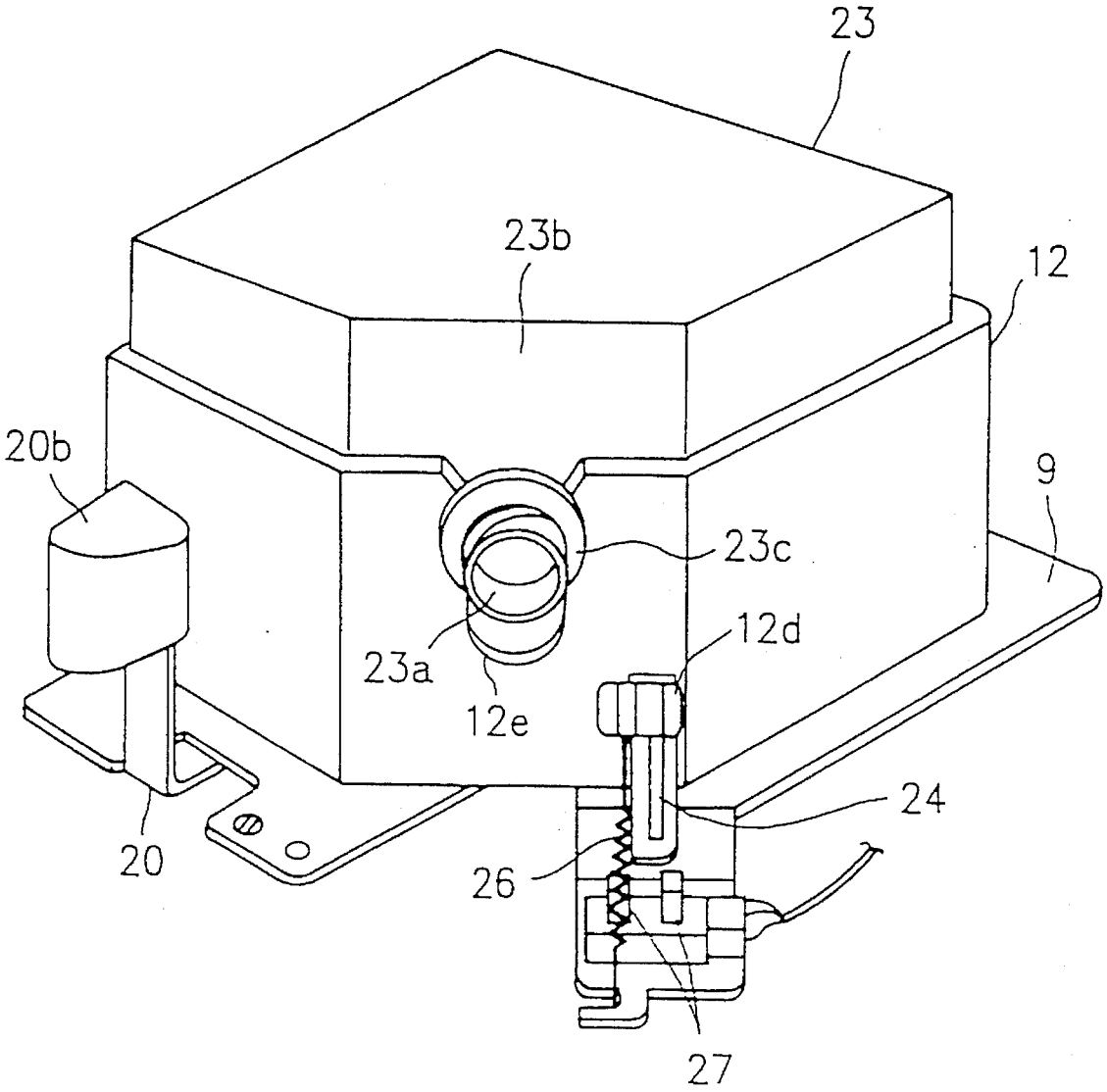
FIG. 2 is a perspective views of the ink container holding device.
Figure 3:
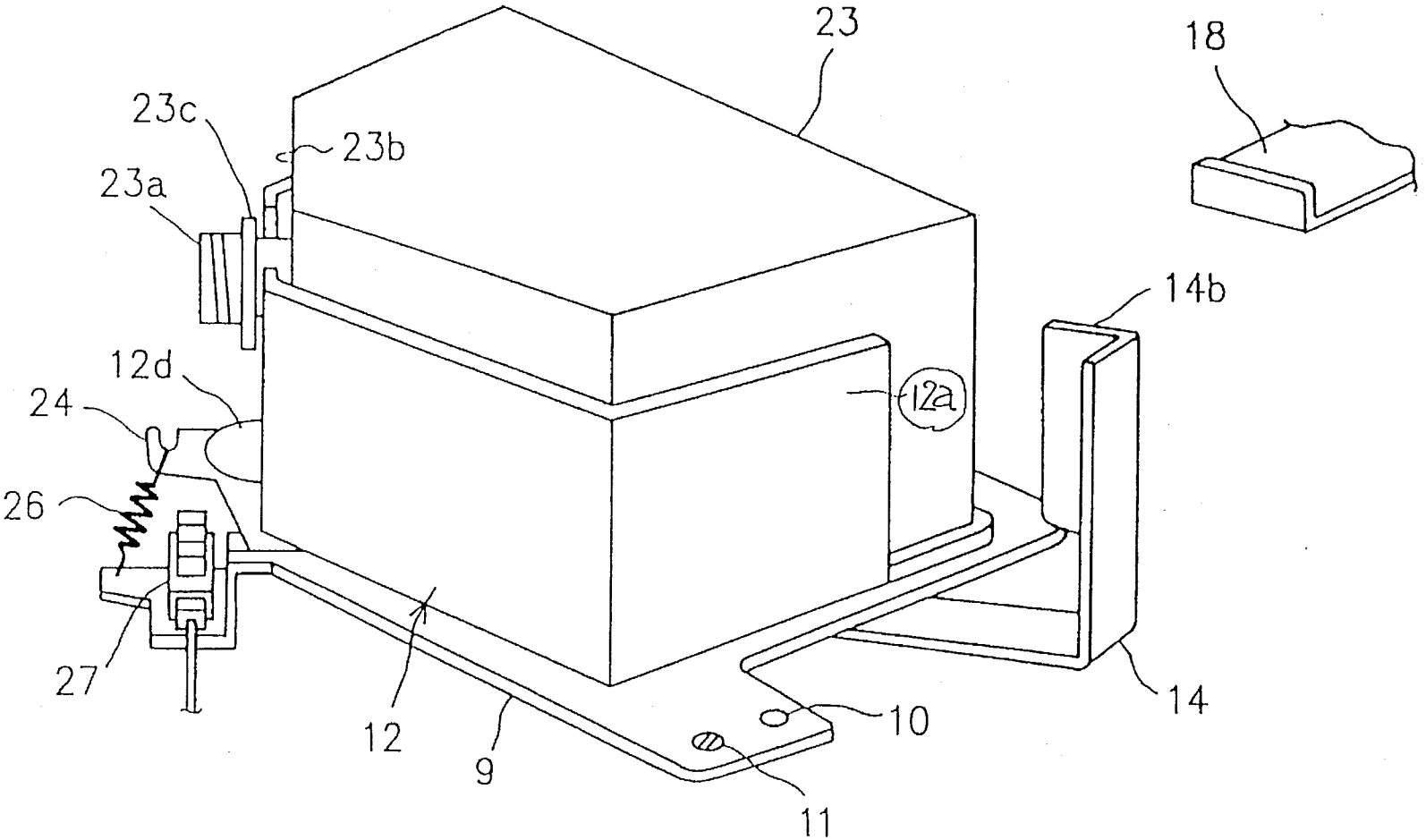
FIG. 3 is a perspective views of the ink container holding device as viewed in different direction from FIG. 2.
Figure 4:
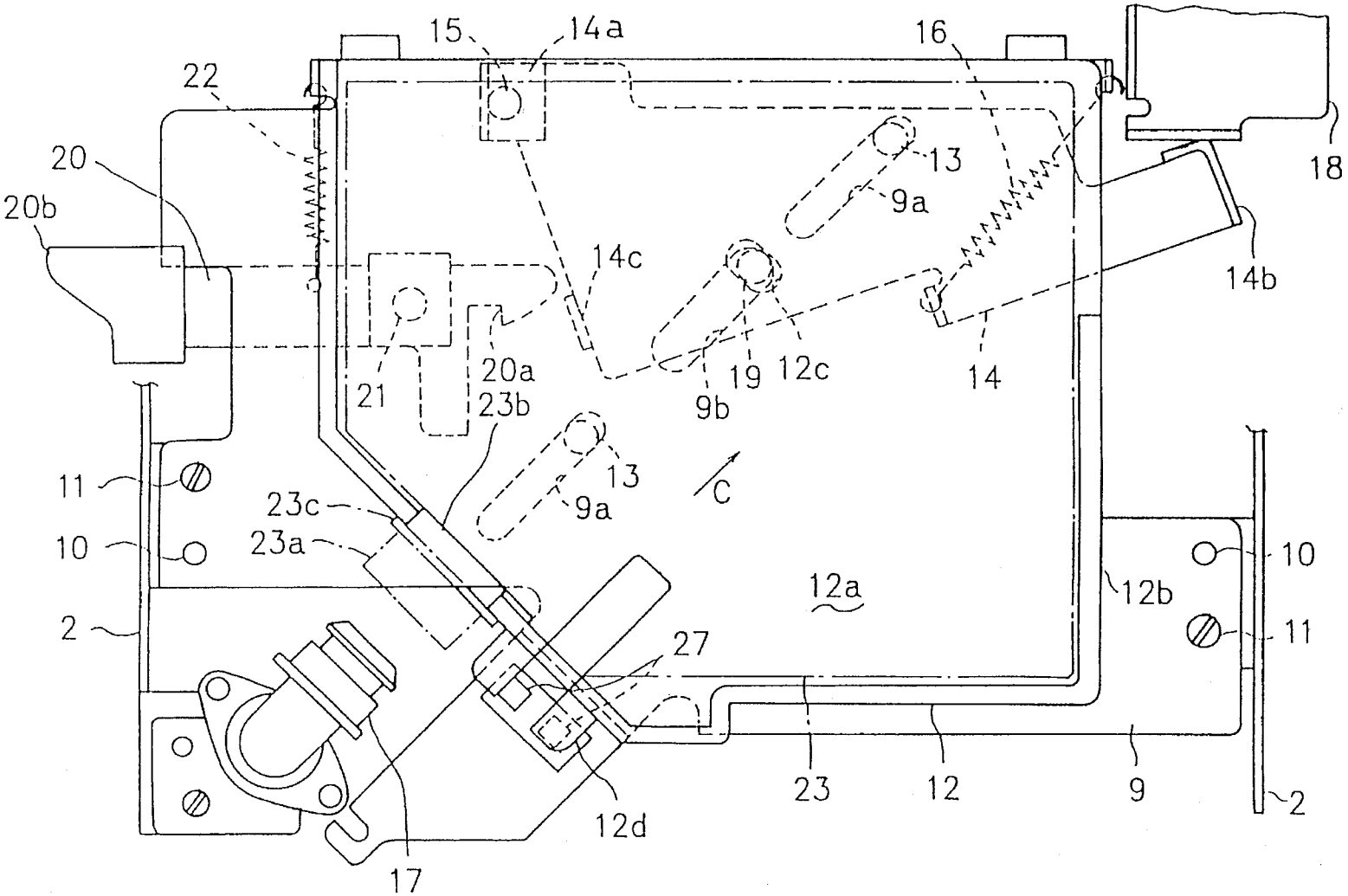
FIG. 4 is a plan view of the ink container holding device.
Figure 5:
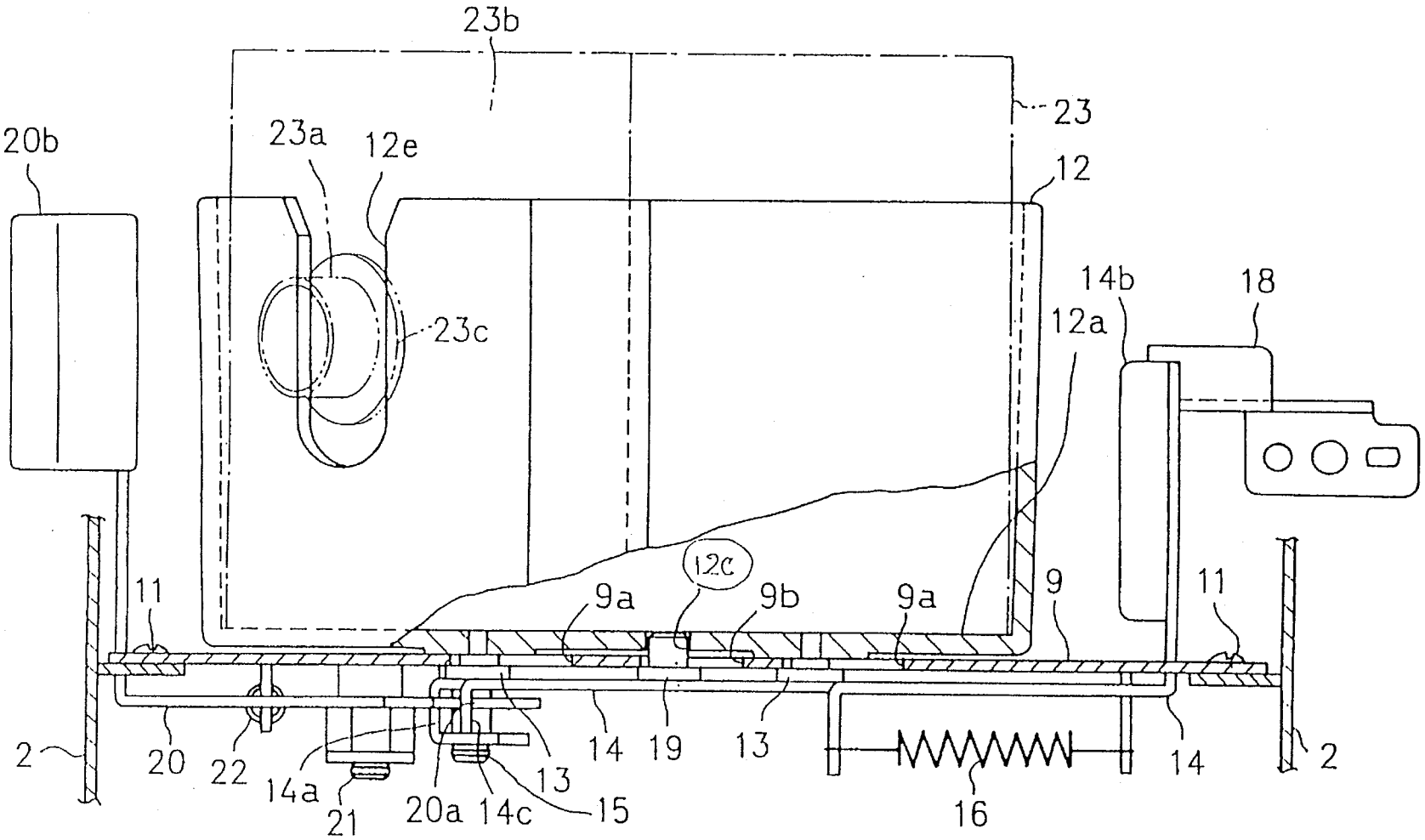
FIG. 5 is a side view of the ink container holding device.

FIGS. 2 and 3 are perspective views of the ink container holding device 6 as viewed in two different directions. FIGS. 4 and 5 are a plan view and a side view of the ink container holding device 6, respectively.

The ink container holding device 6 is a unit with a holder table 9 employed as a base, and it is fixedly secured to the supporting member 2 with pins 10 and screws 11.

As shown in FIG. 4, stepped screws 13 and 13 are secured to the lower surface of the bottom **12*a* of a pack holder 12** which forms container holding means.

The stems of the stepped screws 13 and 13 are loosely engaged with elongated holes **9*a* and 9*a* which are formed in the holder table 9. Each of the elongated holes 9*a* forms 45° with the direction in which the supporting member 2 is moved by the rail-like guide mechanism 4 (hereinafter referred to as "a supporting-member moving direction", when applicable). Hence, when a force is applied to the ink container holding device 6 in the supporting-member moving direction, the ink container holding device 6 is linearly slid on the holder table 9 between a disconnecting position shown in FIG. 4 and a connecting position shown in FIG. 6**.

The device 6 has a hook lever 14. The hook lever 14, as shown in FIG. 5, is substantially L-shaped in vertical section, and its one end portion **14*a* is pivotally mounted on a shaft 15 extending from the lower surface of the holder table 9; that is, the hook lever 14 is pivotable about the shaft 15, over the lower surface of the holder table 9**.

The hook lever 14 is held urged counterclockwise (in FIG. 4) by the elastic force of a holder hook spring 16 connected between the hook lever 14 and the holder table 9.

The other end portion **14*b* of the hook lever 14 serves as an operating lever for coupling the ink container to the ink suction port 17 provided for an ink pump. The operating lever is held upright outside a side wall 12*b* of the pack holder 12**.

The aforementioned hook lever 14 and a holder set board 18 form operating means. The holder set board 18 is secured to the frame of the printing machine body, and its end portion is on a path along which the other end portion **14*b* of the hook lever 14 is moved when the printing drum 3 is set inside the printing machine body. When the printing drum 3 is moved in the direction of the arrow A (towards the printing position) so as to be set inside the printing machine body, the hook lever 14 is swung about the shaft 15 from the position shown in FIG. 4 to the position shown in FIG. 6 against the elastic force of the holder hook spring 16 because the movement of the other end portion 14***b* of the hook lever 14 is blocked by the holder set board 18.

A guide pin 19 is fixedly embedded in the hook lever 14 at the center. The guide pin 19 extends upright, and is engaged with an elongated hole 9*b* formed in the holder table 9. An elongated hole 12*c* is formed in the bottom 12*a* of the pack holder 12 in such a manner that it extends across the elongated hole 9*b*. The guide pin 19 is loosely engaged with the elongated hole 12*c*, too.

The elongated hole 9*b* is extended in parallel with the above-described two elongated holes 9*a* and 9*a*.

A release lever 20 is provided on the lower surface of the holder table 9. The release lever 20 is substantially L-shaped in section, and is pivotably supported through a shaft 21 on the holder table 9 so that it is swung over the lower surface of the holder table 9.

The release lever 20 is held urged clockwise (in FIG. 4) by the elastic force of a set spring 22 connected between the release lever 20 and the holder table 9.

One end portion 20*a* of the release lever 20 is formed into a hook-like locking portion 20*a* which is engaged with an engaging portion 14*c* of the hook lever 14; and the other end portion 20*b* extends outside the side wall 12*b* of the pack holder, thus serving as an operating lever which is used to disengage the locking portion 20*a* from the engaging portion 14*c* of the hook lever 14.

As shown in FIGS. 2 and 3, the ink container 23 is set in the pack holder 12 from above. The ink container 23 is substantially in the form of a cube from which a triangular prism is removed, thus having an oblique surface 23*b*.

The ink container 23 is of a dual structure-(or so-called "bag-in-box" structure) comprising an inner bag which is filled with printing ink, and an outer box in which the inner bag is set. The inner bag is made of a soft material so that it is decreased in volume in proportion to the amount of use of the printing ink. The outer box is made of a material such as thick paper or synthetic resin which is much higher in rigidity than the inner bag. The ink container 23 has an ink discharge port 23*a*.

As shown in FIG. 2, when the ink container 23 is set in the pack holder 12, the ink discharge port 23*a* is engaged with a U-shaped groove 12e formed in the pack holder 12.

The ink discharge port 23*a* of the ink container 23 has a flange 23*c* at the base. The ink container 23 is set in the pack holder 12 in such a manner that the side wall of the pack holder 12 is held between the flange 23*c* and the outer box of the ink container 23.

The side wall 12*b* of the pack holder 12 is shaped in conformance with the external form of the ink container 23, thus guiding the insertion of the ink container 23 into the pack holder 12.

The side wall 12*b* of the pack holder 12 functions as follows: That is, when the ink discharge port 23*a* of the ink container is connected to or disconnected from the ink suction portion 17, the side wall 12*b* widely covers and supports the side surfaces of the ink container 23, thereby to prevent the relatively flexible ink container from being deformed or damaged.

As shown in FIGS. 2, 3, 7 and 8, the upper portion of a pack detecting board 24 which is an element to be detected, is supported through a shaft 25 on a bearing 12*d* formed on the side wall 12*b* of the pack holder 12 in such a manner that the pack detecting board 24 is pivotable about the shaft 25, and the lower end portion is formed into an engaging piece 24*a*.

Figure 7:
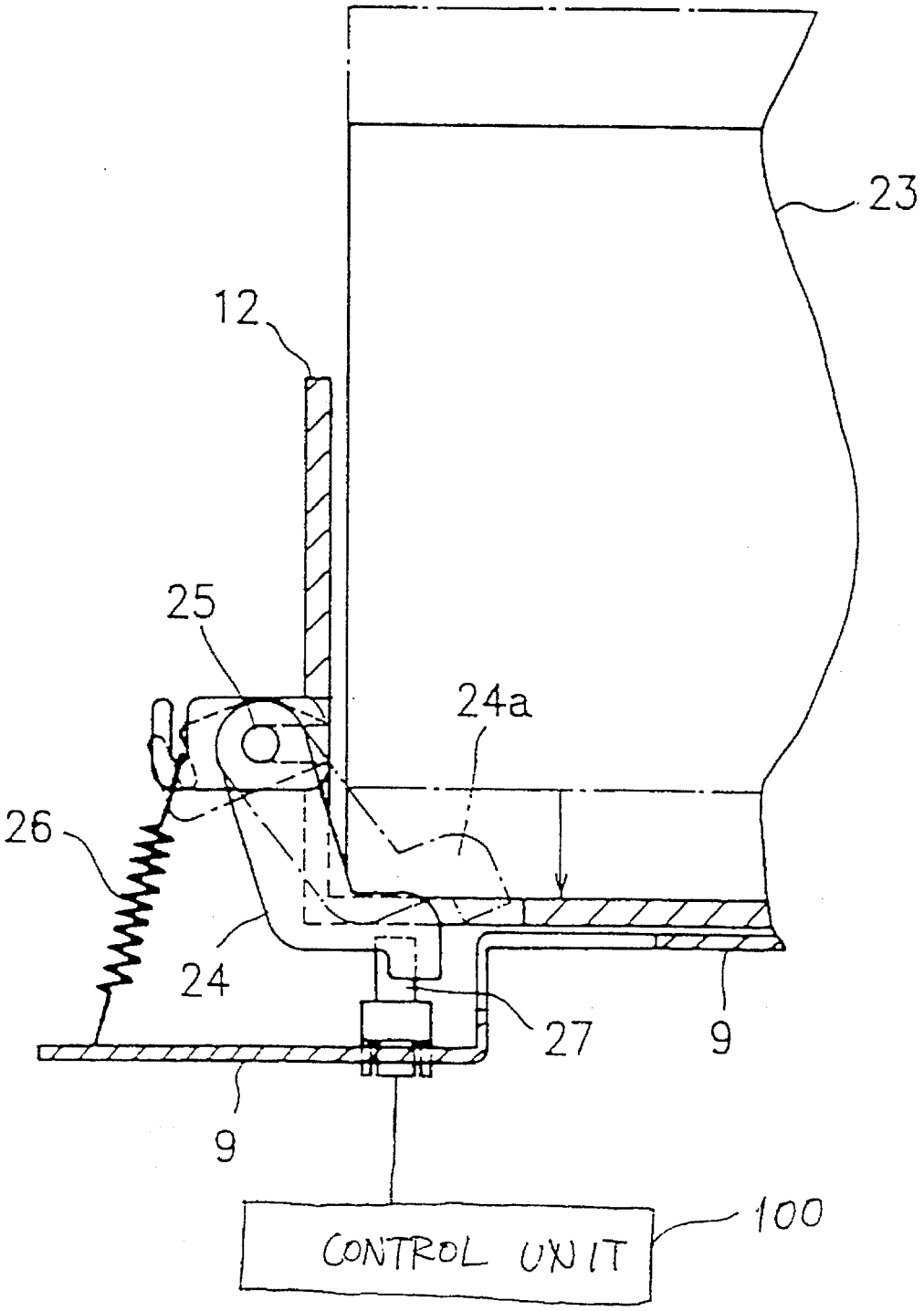
FIG. 7 is a sectional views showing a detector and an element to be detected by the detector.
Figure 8:
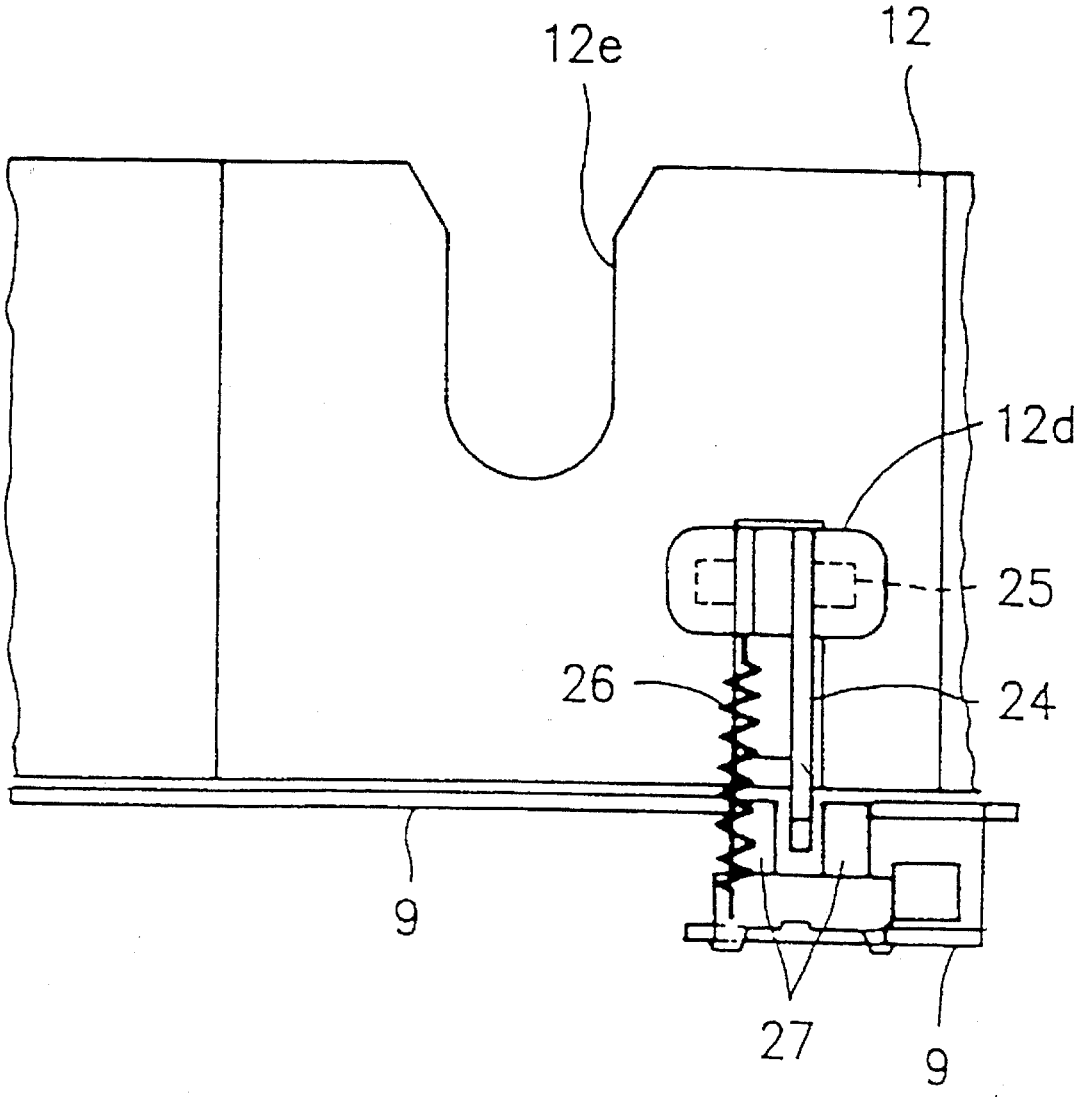
FIG. 8 is a side views showing the detector and the element.

The pack detecting board 24 is held as indicated by the one-dot chain line in FIG. 7, being urged counter-clockwise (in FIG. 7) by a coil spring 26 connected between the pack detecting board 24 and the holder table 9.

When the ink container 23 is set correctly, the engaging piece 24*a* is pushed downwardly by the ink container 23, so that the pack detecting board 24 is held as indicated by the solid lines in FIG. 7.

A detector, namely, a pack sensor 27 is provided for the pack detecting board 24. The pack sensor 27 comprises a light emitting unit and a light receiving unit, and is fixedly mounted on the holder table 9.

When the ink container 23 is correctly set in the pack holder 12, the light beam from the light emitting unit is intercepted by the engaging piece 24*a* of the pack detecting board 24, thus not reaching the light receiving unit. From this fact, the pack sensor 27 determines that the ink container has been correctly set in the pack holder, and outputs a detection signal, which is applied to control means 100.

Now, a procedure of setting the ink container will be described.

First, as shown in FIG. 1, the supporting member 2 is pulled out of the printing machine body to the position where the printing drum 3 can be exchanged. Under this condition, there is nothing above the pack holder which may obstruct the mounting or demounting of the ink container.

Next, as shown in FIGS. 4 and 5, the ink container 23 is gradually pushed into the pack holder 12 with the ink discharge port 23*a* set in the U-shaped groove 12*e* of the pack holder until the bottom of the former 23 abuts against the bottom 12*a* of the pack holder 12.

Figure 6:
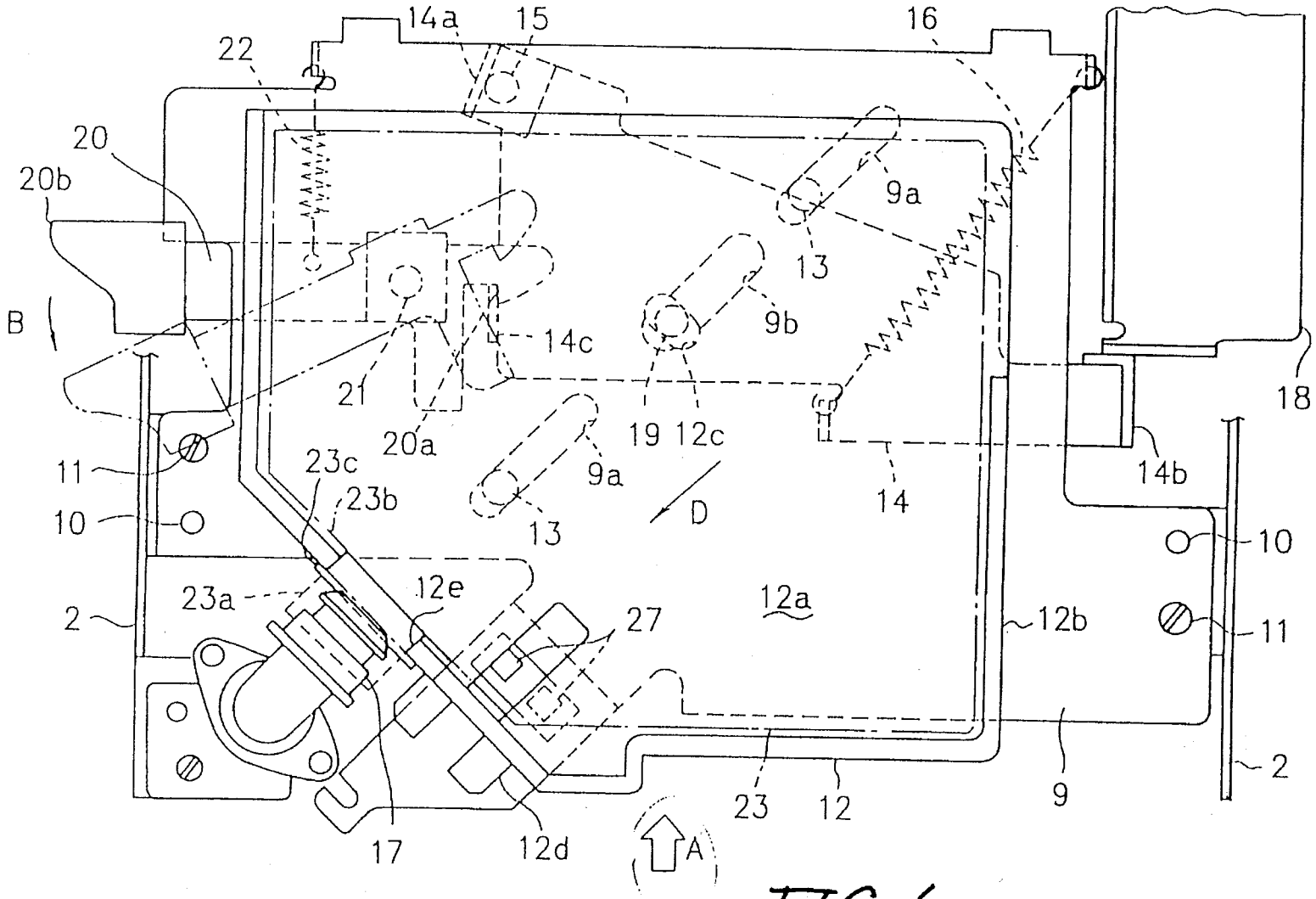
FIG. 6 is a plan view for a description of the operation of the ink container holding device.

Thereafter, the printing drum 3 is moved to the printing position (in the direction of the arrow A in FIG. 6). At the end of the movement, the hook lever 14 is pushed by the holder set board 18 to the position as shown in FIG. 6, where it is engaged with the engaging portion 20*a* of the release lever 20 again.

As the hook lever 14 is moved in the above-described manner, the pack holder 12 is moved in the direction of the arrow D with the aid of the guide pin 19, and stopped at the position shown in FIG. 6.

As a result, the ink discharge port 23*a* of the ink container 23 is engaged with the ink suction portion 17.

In this operation, since the ink discharge port 23*a* of the ink container 23 has the flange 23*c* as was described before, a force for engaging the ink discharge port 23*a* with the ink suction port 17 is received by the pack holder 12 through the U-shaped groove 12*e* engaged with the flange 23*c*; that is, no unwanted force is applied to the ink container body.

When the start switch of the printing machine is turned on with the ink container 23 set therein, the printing machine 1 starts a printing operation.

If, in this case, the ink container 23 is not correctly set in the pack holder 12, the bottom of the ink container 23 is not brought into contact with the engaging piece 24*a* of the pack detecting board 24; that is, it is held at the position indicated by the one-dot chain line in FIG. 7. Hence, even if the printing drum 3 is moved to the printing position; that is, even if the pack holder 12 is positioned as shown in FIG. 6, the pack sensor 27 cannot detect the pack detecting board 24.

In response to the fact that the pack detecting board has not been detected, a control unit 100 serving as control means operates to cause the display section of the printing machine body to display the fact that the setting of the ink container is unsatisfactory when the printing drum 3 is set at the printing position.

At the same time, the control means 100 operates to inhibit the operation of the printing machine. That is, even if the start switch is turned on, the printing machine is not started, and the pump connected to the ink suction port 17 is prevented from sucking the ink.

When, on the other hand, the ink container 23 is correctly set in the pack holder 12, the bottom of the ink container 23 is brought into contact with the engaging piece 24*a* of the pack detecting board 24. Thereafter, when the printing drum 3 is moved to the printing position, the pack detecting board 24 is detected by the pack sensor 27, so that the printing machine is allowed to start the printing operation.

Replacement of the ink container 23 is carried out as follows:

First, the printing drum 3 is moved to the non-printing position (as shown in FIG. 4), and the holder set board 18 is disengaged from the operating lever 14*b* of the hook lever 14.

Next, the operating lever 20*b* of the release lever 20 is swung in the direction of the arrow B in FIG. 6, to disengage the engaging portion 20*a* of the release lever 20 from the engaging portion 14*c* of the hook lever 14.

As a result, the hook lever 14 is moved by the elastic force of the holder hook spring 16 to the position shown in FIG. 4, and the pack holder 12 is moved in the direction of the arrow C with the aid of the guide pin 19, and stopped at the position shown in FIG. 4.

As a result, the ink discharge portion 23*a* of the ink container 23 is disconnected from the ink suction portion 17.

Under this condition, the ink container 23 can be taken out of the pack holder 12 merely by moving it upwardly; that is, it can be replaced with a new one.

The ink container 23 may be in the form of a hexahedron. However, in the embodiment, it is in the form of a heptahedron having an oblique surface 23*b* which is formed by removing a triangular prism isosceles-triangular in section from a hexahedron, and the ink suction port 17 which is connected to the suction side of the ink pump is provided at or near the place which corresponds to the position of the removed triangular prism with the ink container 23 set in the pack holder 12. This means the effective use of the narrow space in the printing machine, and contributes to miniaturization of the latter.

In the above-described embodiment, the printing drum is moved horizontally between the printing position inside the printing machine body and the non-printing position outside the latter. However, the printing machine may be so modified that, instead of the rail-like guide mechanism 4, a plurality of parallel link mechanisms equal in length are employed to support the printing drum, and the printing drum is moved along an arc whose radius corresponds to the linkage.

Figure 9:
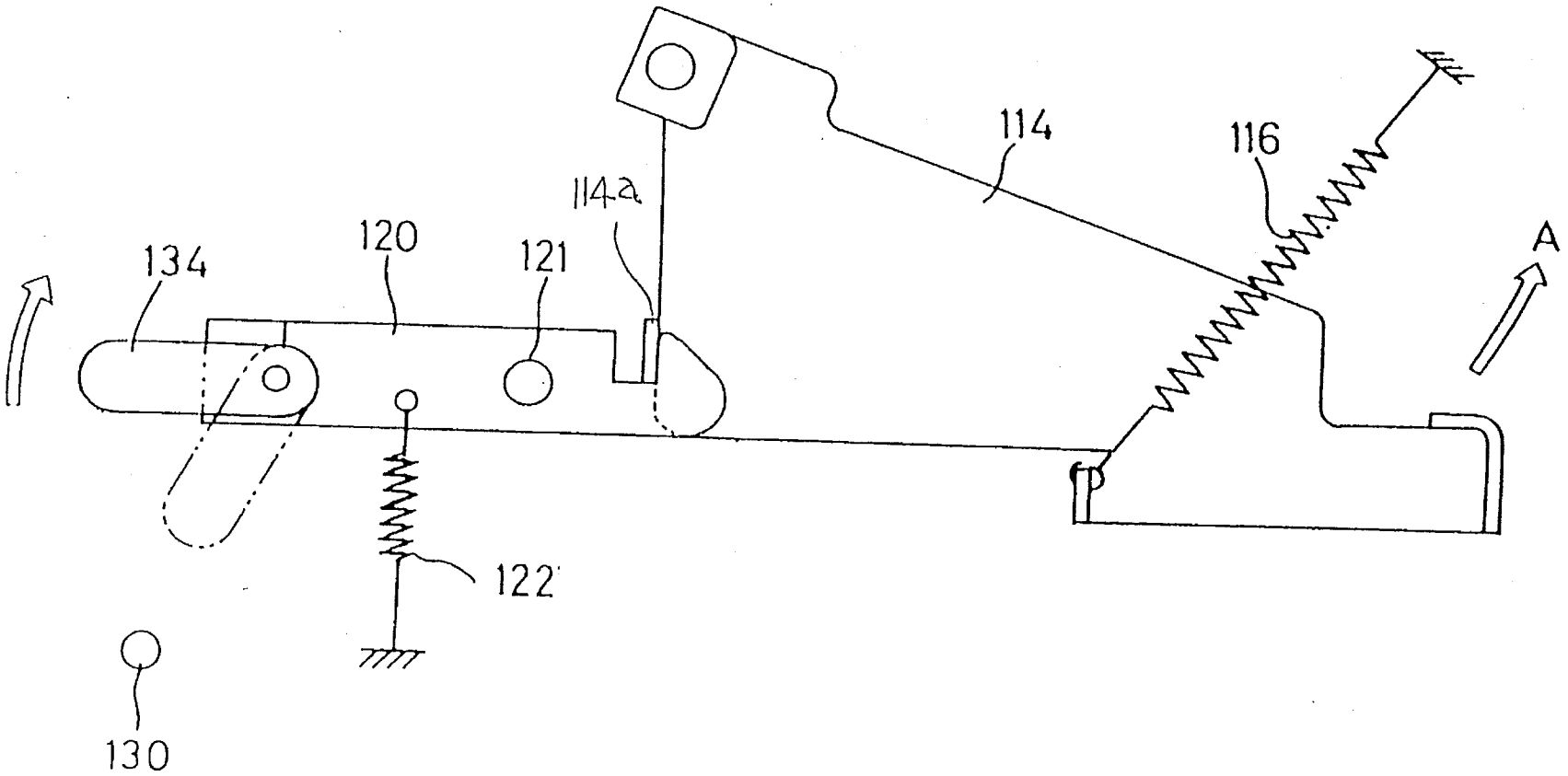
FIG. 9 is a plan view showing a modification of locking means shown in the ink container holding device.

In the above-described embodiment, only when the supporting member 2 is at the non-printing position, the locking means 20 is manually operated so that it is disengaged from the ink container holding means 12. However, the printing machine may be modified as shown in FIG. 9. That is, in the modification, locking means, namely, a release lever 120 is provided as follows: While the supporting member is moved to the non-printing position, a dog 130 secured to the machine frame swings the release lever 120 about a shaft 121 in the direction of the arrow against the elastic force of a return spring 122, so that the release lever 120 is disengaged from a portion 114*a* of a hook lever 114. As a result, the hook lever 114 is swung in the direction of the arrow A by the elastic force of a spring 116, so that the ink container holding means 12 is moved from the connecting position to the disconnecting position.

The release lever 120 has an engaging portion 134 which is engaged with the dog 130. Normally the engaging portion 134 is elastically snugly held as indicated by the solid line in FIG. 9; however, when it is engaged with the dog 130 during movement of the supporting member from the non-printing position to the printing position, it is swung as indicated by the two-dot chain line.

Furthermore, in the above-described embodiment, by moving the supporting member 2 to the printing position, the ink container holding means 12 is moved to the connecting position with the aid of the hook lever 14. However, the printing machine may be so modified that the hook lever 14 is eliminated, and by moving the supporting member 2 to the printing position, the ink container holding means 12 is moved to the connecting position directly by the holder set board 18.

Moreover, in the above-described embodiment, the pack detecting board 24 is deflected in one direction when the ink container 23 is set in the ink container holding means 12, and the pack sensor 27 determines whether or not the pack detecting board 24 is deflected in one direction when the ink container holding means 12 is moved to the connecting position where the ink container is connected to the ink suction port provided for the ink pump. However, the printing machine may be modifies as follows: A through-hole is formed in the bottom of the ink container holding means 12, and a photo-sensor is so arranged as to confront with the through-hole when the ink container holding means is moved to the aforementioned connecting position. That is, the photosensor is so positioned as to determine whether or not the through-hole is closed by the ink container when the ink container holding means 12 is moved to the connecting position, thereby to determine whether or not the ink container is correctly set in the ink container holding means 12.

The ink container holding device of the invention has the following effects or merits:

(1) In order to set, remove or replace the ink container, the ink container holding means is pulled out of the printing machine body so that the ink container is handled at the position which is away from the operating panel and other structures which may obstruct the handling of the ink container. Since the ink container holding means is pulled out of the printing machine body as was described above, the operator can see the ink container holding means directly even if he is in an erect posture. In other words, the replacement of the ink container can be quickly achieved by the operator in a comfortable posture.

(2) Merely by returning the printing drum to the printing position in the printing machine body after the ink container is set in the ink container holding means, the ink discharge port of the ink container is connected to the ink suction port provided for the ink pump. Hence, the replacement of the ink container can be achieved readily and positively even by a person not skilled in the art.

(3) The printing operation is permitted only when the ink container is correctly set in the ink container holding means, and is positively connected to the ink suction port provided for the ink pump. In other words, the difficulty is eliminated that the printing operation is started although the ink container is not correctly set in the ink container holding means. Accordingly, the difficulties are also eliminated that, during printing, the supplying of the printing ink is stopped or the printing ink leaks out through the junction of the ink discharge port of the ink container and the ink suction port of the ink pump.

(4) The ink container holding means is mounted on the supporting member which is adapted to move the printing drum between the printing position inside the printing machine body and the non-printing position outside the printing machine body. Hence, it is unnecessary to additionally provide a mechanism for moving the ink container holding means between the position inside the printing machine body and the position outside the printing machine body. This means that the printing machine is simplified as much, and the limited space in the printing machine is effectively utilized, which contributes to reduction in weight and in size of the printing machine body.

What is claimed is:

1. An ink container holding device in combination with a rotary printing machine, said rotary printing machine including a printing machine body, an ink container detachably disposed in said printing machine body and having an ink discharge port, and an ink supply pump having an ink suction port, wherein an ink is supplied from said ink discharge port of said ink container to said ink suction port of said ink supply pump, said ink container holding device comprising:

a supporting member which is movable between a first position inside said printing machine body and a second position outside said printing machine body;

ink container holding means provided on said supporting member, for holding said ink container, wherein said ink container holding means is movable between a connecting position where said ink discharge port of said ink container is connected to said ink suction port of said ink supply pump and a disconnecting position where said ink discharge port is disconnected from said ink suction port; and operating means for moving said ink container holding means to said connecting position in association with the movement of said supporting member to said first position inside said printing machine body.

2. An ink container holding device according to claim 1, further comprising:

detecting means for detecting when said ink container is set in said ink container holding means.

3. An ink container holding device according to claim 1, further comprising:

detecting means for detecting when said ink container is set in said ink container holding means, to output a detection signal; and control means for controlling said printing machine such that said printing machine is allowed to perform a printing operation when, with said supporting member set at said first position inside said printing machine body, said detecting means outputs said detection signal, and said printing machine is not allowed to perform the printing operation when, with said supporting member set at said first position, said detecting means outputs no detection signal.

4. An ink container holding device according to claim 1, further comprising:

locking means for locking said ink container holding means at said connecting position once said ink container holding means moves to said connecting position where said ink discharge port of said ink container is connected to said ink suction port.

5. An ink container holding device according to claim 4, wherein said ink container holding device further comprises urging means for urging said ink container holding means from said connecting position towards said disconnecting position, said locking means is so designed as to eliminate the locking of said ink container holding means when said supporting member is at said second position outside said printing machine body, and when the locking of said ink container holding means is eliminated by said locking means, said ink container holding means is moved to said disconnecting position by the energizing force of said urging means.

6. An ink container holding device according to claim 1, wherein said rotary printing machine further includes a printing drum which is turned with an original form on an outer cylindrical surface thereof, and said supporting member rotatably supports said printing drum.

7. An ink container holding device in combination with a rotary printing machine, said rotary printing machine including a printing machine body, an ink container detachably disposed in said printing machine body and having an ink discharge port, and an ink supply pump having an ink suction port, wherein an ink is supplied from said ink discharge port of said ink container to said ink suction port of said ink supply pump, said ink container holding device comprising:

a pack holder detachably receiving said ink container;

a support table on which said pack holder is slidably mounted, wherein said pack holder is slidable between a connecting position where said ink discharge port of said ink container is connected to said ink suction port of said ink supply pump and a disconnecting position where said ink discharge port of said ink container is disconnected from said ink suction port of said ink supply pump;

a supporting member on which said support table is secured, said supporting member being movable between a first position inside said printing machine body and a second position outside said printing machine body;

a holder set board secured to said printing machine body; and a hook lever connecting to said pack holder, wherein said hook lever moves said pack holder to said connecting position by engaging said hook lever with said holder set board in accordance with said supporting member moving to said first position.

8. An ink container holding device according to claim 7, wherein said ink container holding device further comprises a guide pin engaging said hook lever with said pack holder, and said support table has an elongated hole into which said guide pin is inserted.

9. An ink container holding device according to claim 7, further comprising:

a holder-hook spring urging said hook lever toward said disconnecting position of said pack holder;

a release lever having a locking portion and an operating portion opposite to said locking portion, said release lever pivotable between a locking position where said locking portion is engaged with said hook lever and a release position where said locking portion is disengaged from said hook lever; and a set spring urging said release lever toward said locking position.

10. An ink container holding device according to claim 7, further comprising:

detecting means for detecting when said ink container is set in said pack holder.

11. An ink container holding device according to claim 7, wherein said pack holder has a side wall shaped in conformance with the external form of said ink container.

12. An ink container holding device according to claim 7, wherein the sliding directions of said pack holder with respect to said support table and said supporting member with respect to the printing machine body makes the angle of 45°.

* * * * *